United States Patent [19]

Firstenberg et al.

[11] 3,967,800

[45] July 6, 1976

[54] CLOTH-BOARD REEL

[76] Inventors: Morris Firstenberg, 225 Cherry Lane, River Edge, N.J. 07661; Daniel Chestnut, 274 Rutledge Ave., East Orange, N.J. 07017; Edward Marshall, 147 President St., Passaic, N.J. 07055

[22] Filed: Nov. 10, 1975

[21] Appl. No.: 630,396

[52] U.S. Cl. ..... 242/222

[51] Int. Cl.[2] ..... B65H 75/06

[58] Field of Search ..... 242/222, 61, 50

[56] References Cited

UNITED STATES PATENTS

| | | | |
|---|---|---|---|
| 1,659,282 | 2/1928 | Scheffey | 242/222 |
| 1,975,906 | 10/1934 | Stewart | 242/222 |
| 3,286,828 | 11/1966 | Yovanovich | 242/222 |
| 3,341,000 | 9/1967 | McKittrick et al. | 242/222 |

*Primary Examiner*—Leonard D. Christian
*Attorney, Agent, or Firm*—Steele & Petock

[57] ABSTRACT

A new and improved cloth-board reel is disclosed which utilizes two corrugated sheets bonded together eliminating the need for an intermediary sheet which was previously considered necessary. The cloth-board reel of the present invention provides the required strength without the more expensive construction previously considered necessary. The corrugated sheets are covered with a wrapper sheet which forms a smooth surface for the cloth and adds to the strength of the cloth-board reel.

5 Claims, 4 Drawing Figures

FIG. 1
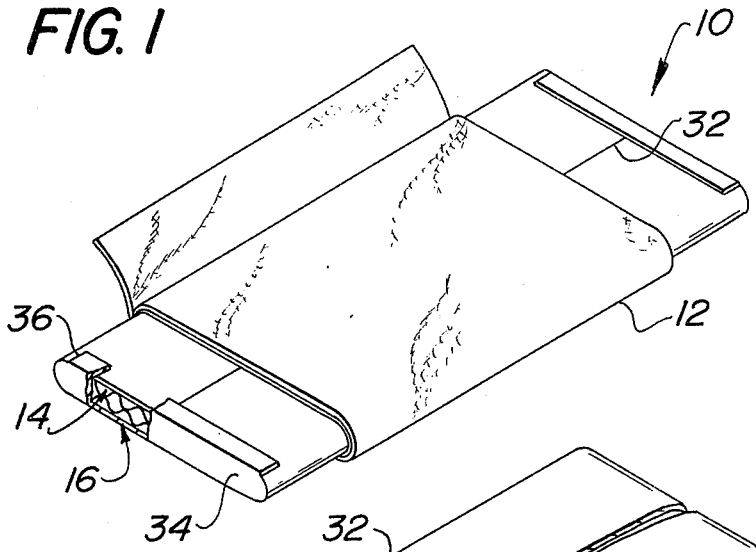
FIG. 2
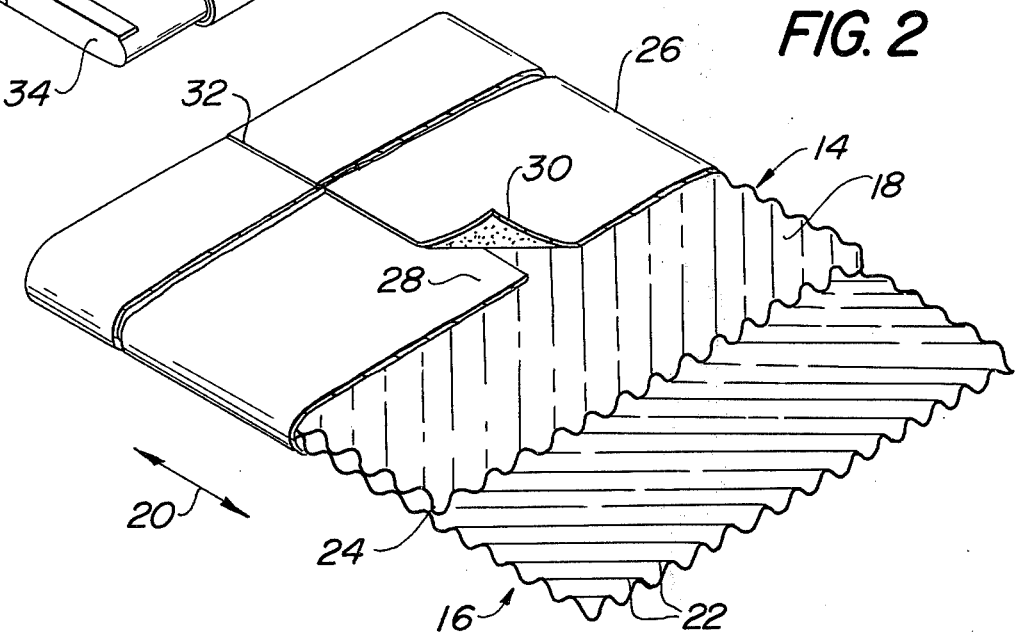
FIG. 3
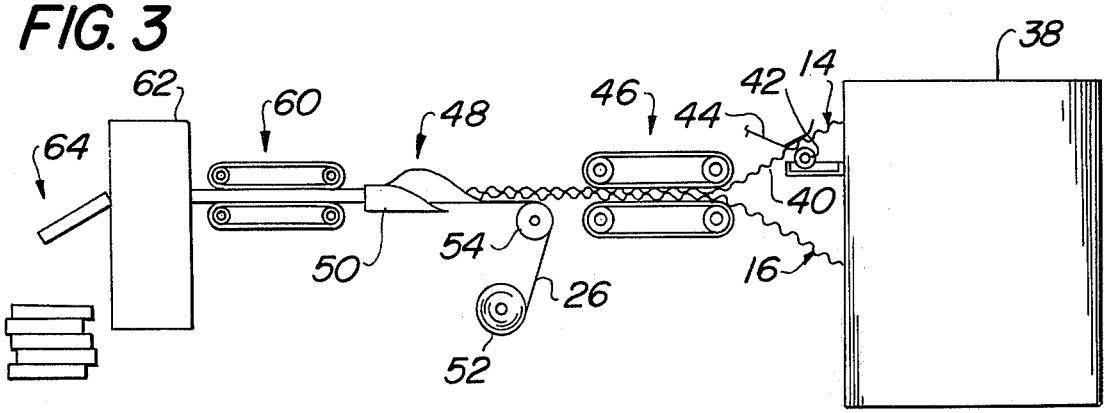
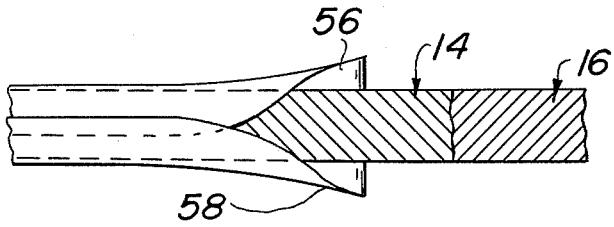
FIG. 4

CLOTH-BOARD REEL

BACKGROUND OF THE INVENTION

This invention relates to a new and improved cloth-board reel, and more particularly relates to a new and improved cloth-board reel which reduces the manufacturing costs and provides the required strength.

Originally, it was considered necessary to provide cloth-board reels fabricated of wood in order to provide the required strength to withstand the torsional and buckling stresses imparted during machine-winding of cloth on the reels. In 1966, U.S. Pat. No. 3,286,828, assigned to the assignee herein, was granted for a new and unobvious cloth-board reel which provided the required strength by fabricating the cloth-board reel from an intermediary sheet with a stiffener sheet adhesively secured to each side of the intermediary sheet. The stiffener sheets disclosed in that patent utilized rectangular shaped corrugations to provide the required strength. The rectangular shaped corrugations, having flattened troughs and crests, provided a substantial adhesive area to the intermediary sheet.

The stresses placed upon a cloth-board reel during the machine winding of cloth are substantial. Prior to U.S. Pat. No. 3,286,828, it was not believed possible to make a completely satisfactory cloth-board reel from relatively inexpensive fabricated paper stock, or other suitable inexpensive material. For more than nine years after the invention of the subject matter of U.S. Pat. No. 3,286,828, it was not believed possible to eliminate the intermediate sheet. The substantial expense of providing the intermediary sheet for large numbers of disposable cloth-board reels was very significant. However, in spite of the significant expense of the intermediate sheet, there was no obvious solution to reducing the cost of manufacture. It was felt by those skilled in the art that it was necessary to have the intermediate sheet in order to provide a continuous bond along the corrugations. It was believed that bonding two corrugated sheets directly together, without the intermediate sheet, would be an impossible reliable continuous manufacturing operation. Furthermore, it was believed that bonding two corrugated sheets directly together would not provide the necessary strength to withstand the stresses to which cloth-board reels are subjected in the machine-winding of cloth.

The problem also existed of placing an adhesive on the crest of the corrugations which were to be bound together. In the prior art where an intermediate sheet was used, both sides of the intermediate sheet were provided with an adhesive as disclosed in U.S. Pat. No. 3,510,383, assigned to the assignee herein. All of the problems encountered in attempts to reduce the cost of cloth-board reels made the solution to the problem unobvious.

SUMMARY OF THE INVENTION

An advantage of the present invention is that it eliminates an element of cloth-board reels which was previously considered to be necessary.

Another advantage of the present invention is that it reduces the amount of material handling in the fabrication of cloth-board reels in accordance with the present invention.

Still another advantage of the present invention is that it reduces the cost of material in the manufacture of cloth-board reels.

Briefly, in accordance with the present invention, a cloth-board reel is fabricated from flexible sheet material. A first longitudinally extending stiffener sheet is provided. The stiffener sheet is provided with corrugations extending obliquely with respect to the longitudinal dimension of the stiffener sheet. A second longitudinally extending stiffener sheet is provided generally congruent with and adhesively secured to the corrugations of said first stiffener sheet. The second stiffener sheet is provided with corrugations extending obliquely to the longitudinal dimension of the second stiffener sheet and transversely of the first stiffener sheet corrugations. A wrapper sheet is provided which extends circumferentially about the first and second stiffener sheets and is adhesively secured to the corrugations of the stiffener sheet.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a view in perspective illustrating a cloth-board reel in accordance with the present invention with a coil of cloth thereon.

FIG. 2 is a view in perspective, partially broken out to show the inner structure, of a cloth-board reel in accordance with the present invention.

FIG. 3 is a diagramatic elevational view illustrating apparatus for the continuous manufacturing of a cloth-board reels in accordance with the present invention.

FIG. 4 is an enlarged plan view of a portion of FIG. 3.

DETAILED DESCRIPTION OF A PREFERRED EMBODIMENT

Referring now to the drawings in detail, wherein like numerals indicate like elements, there is shown in FIG. 1 a cloth-board reel 10 having a coil fabric 12 thereon. The cloth-board reel 10 is of a generally flat, substantially rectangular shape.

Referring now to FIGS. 1 and 2 taken together, there is shown a first stiffener sheet 14 and a second stiffener sheet 16 arranged in congruent overlying relationship. Each of the stiffener sheets 14 and 16 is provided with a series of parallel corrugations extending diagonally across the sheets. Stiffener sheet 14 is provided with corrugations 18 extending obliquely to the longitudinal dimension or axis of stiffener sheet 14. The longitudinal dimension or axis is indicated in FIG. 2 by double headed arrow 20. Stiffener sheet 16 is provided with corrugations 22 which extend obliquely to the longitudinal axis or longitudinal dimension of the stiffener sheets. The corrugations, by way of example and not by way of limitation, may lie along a direction which forms an angle of 45° to the longitudinal axis of the stiffener sheets. However, other suitable angles may be used. The corrugations 18 and 22 of stiffener sheets 14 and 16, respectively, are arranged to be transverse to each other. By way of example and not by way of limitation, the corrugations 18 and 22 may cross at right angles. This is especially the case where the corrugations on each sheet form an angle of 45° with the longitudinal axis.

Stiffener sheets 14 and 16 are adhesively secured to each other by means of adhesive bonds at the point where the corrugations 18 of stiffener sheet 14 come into contact with the corrugations 22 of stiffener sheet 16, such as for example at point 24.

Circumposed about the adhesively secured assemblage of stiffener sheets 14 and 16 is a wrapper sheet 26. The wrapper sheet 26 may be of generally rectangular outline configuration and circumposed about the stiffener sheets 14 and 16, having portions laying in facing engagement with the outer peaks of corrugations 18 and 22. Further, the inner surface of wrapper sheet 26 may be coated with an adhesive to firmly secure the wrapper sheet to the crest of the corrugations 18 and 22. The wrapper sheet may be coextensive with the stiffener sheets 14 and 16, longitudinally thereof, and may have overlapping edge portions 28 and 30 adhesively secured together to define a seam 32 extending longitudinally between opposite ends of the assembly.

To cover and further stiffen the assembly, an end piece 34 is engaged in covering relationship across each exposed end of the assembled stiffening sheets 14 and 16 and wrapper sheet 26. The end piece 34 may include a pair of flaps 36, each swingable into overlying facing engagement with the adjacent portion of wrapper sheet 26 and adhesively secured thereto. Each end piece 34 and its adjacent flaps 36 may be integrally fabricated, for example from cardboard or the like. The flaps may be hingedly connected to the end piece by means of scorelines. This end construction adds strength to the entire assembly, as well as serving to resist local damage at the end regions.

The entire cloth-board reel, except for the adhesive, may be fabricated from paper stock, such as thin cardboard or any other relatively inexpensive sheet material. The stiffener sheets 14 and 16, wrapper or covering sheet 26 and the end pieces 34 with flaps 36 may be comprised of relatively thin cardboard or its equivalent and may preferably be fabricated out of such paper stock.

Referring now to FIGS. 3 and 4, there is shown apparatus for fabricating cloth-board reels in accordance with the present invention. Referring more particularly now to FIG. 3, there is shown a production line for the manufacture of cloth-board reels including corrugating apparatus, generally designated at 38. Such corrugating apparatus is well known and need not be discussed here in detail. Corrugated stiffener sheets 14 and 16 are provided as shown from corrugating apparatus 38. Corrugated stiffener sheet 14 is provided with an adhesive on its lower crest 40 of its corrugations. The adhesive is applied by means of an adhesive applicator in the form of a roller 42. Stiffener sheet 14 is held in contact with roller 42 by means of a resilient or spring bias member 44.

The corrugated sheets 14 and 16 pass through a laminating station 46 where the crests of the corrugations of the corrugated sheets are moved into engagement with each other and the adhesive on the corrugations of stiffener sheet 14. The laminated stiffener sheets 14 and 18 are bound together in the laminating station 46.

This laminated structure then passes to a wrapping station 48 where a covering or wrapping sheet 26 is passed longitudinally with the laminated structure through a wrapping or folding former 50 to wrap sheet 26 around the laminated structure. The wrapper sheet 26 may be supplied from a reel 52 over a roll 54 for movement longitudinally with the laminated structure through former 50. The folding of the wrapper sheet 26 about the laminated structure comprised of stiffener sheets 14 and 16 is shown in greater detail in FIG. 4. Referring to FIG. 4, it is seen that opposite longitudinal margins 56 and 58 of the wrapper sheet 26 are folded into overlapping engagement, and may be adhesively secured together, as by passage through pressure securing station 60.

From pressure securing station 60, the wrapped laminated structure may pass to a severance or cut-off station 62 in which the laminated wrapped structure is cut into predetermined lengths and deposited at 64. Predetermined lengths are then provided with end pieces 34 and are then complete for shipment after the application of labels, if desired.

In view of the above, the present invention may be embodied in other specific forms without departing from the spirit or essential attributes thereof and, accordingly, reference should be made to the appended claims, rather than to the foregoing specification as indicating the scope of the invention.

We claim:

1. A cloth-board reel fabricated from flexible sheet material, comprising:

a first longitudinally extending stiffener sheet, said first stiffener sheet having corrugations extending obliquely with respect to the longitudinal dimension of said stiffener sheet, a second longitudinally extending stiffener sheet generally congruent with and adhesively secured to said corrugations of said first stiffener sheet, said second stiffener sheet having corrugations extending obliquely with respect to the longitudinal dimension of said second stiffener sheet and transversely of said first stiffener sheet corrugations, and a wrapper sheet extending circumferentially about said first and second stiffener sheets and adhesively secured to the corrugations of said stiffener sheets.

2. A cloth-board reel according to claim 1, said first and second stiffener sheet corrugations extending obliquely generally 45° to the longitudinal dimension of said stiffener sheets.

3. A cloth-board reel according to claim 1, said wrapper sheet comprising an integral generally rectangular piece having overlapping edge portions adhesively secured together and defining a longitudinally extending seam.

4. A cloth-board reel according to claim 3 including an end piece mounted over each pair of adjacent ends of said stiffener sheets, said end pieces including flaps secured to said wrapper sheet.

5. A cloth-board reel fabricated from flexible sheet material, comprising:

a first longitudinally extending stiffener sheet, said first stiffener sheet having corrugations extending across said stiffener sheet generally 45° to the longitudinal dimension thereof, a second longitudinally extending stiffener sheet, said second stiffener sheet having corrugations extending approximately 45° obliquely across said second stiffener sheet transversely of said first stiffener sheet corrugations, said second stiffener sheet corrugations being in facing engagement with and adhesively secured to said corrugations of said first stiffener sheet, a wrapper sheet extending circumferentially about said first and second stiffener sheets and adhesively secured to the corrugations of said first and second stiffener sheets.

* * * * *